US006315375B1

(12) United States Patent
Reeves et al.

(10) Patent No.: US 6,315,375 B1
(45) Date of Patent: Nov. 13, 2001

(54) DEVICE FOR DISPLAYING ITEMS AND METHOD OF MAKING SAME

(75) Inventors: Lisa Marie Reeves; Devlan Duane Reeves, both of Edgerton, KS (US)

(73) Assignee: New Century Displays, Inc., New Century, KS (US)

( * ) Notice: Subject to any disclaimer, the term of this patent is extended or adjusted under 35 U.S.C. 154(b) by 0 days.

(21) Appl. No.: 09/573,857

(22) Filed: May 18, 2000

Related U.S. Application Data

(63) Continuation of application No. 29/105,157, filed on May 19, 1999, now Pat. No. Des. 441,223.

(51) Int. Cl.[7] ..... A47F 3/00

(52) U.S. Cl. ..... 312/139.2; 312/126; 312/234; 40/725; 40/800

(58) Field of Search ..... 312/126, 114, 312/138.1, 139.2, 204, 117, 234, 242, 245, 246; 40/800, 725, 765, 766, 768; 206/579, 315.9, 777, 523

(56) References Cited

U.S. PATENT DOCUMENTS 1,186,642 * 6/1916 Alamy ..... 312/114
3,554,625 * 1/1971 Sly, Sr. ..... 312/126 X
3,611,604 * 10/1971 Saltzman ..... 40/768
4,049,949 * 9/1977 Fitzsimons ..... 206/315.9 X
4,269,461 * 5/1981 Roach, Jr. ..... 312/244
5,118,171 * 6/1992 Ortiz ..... 312/114
5,195,633 * 3/1993 Kaminski ..... 206/315.9
5,522,507 * 6/1996 Cruz ..... 206/579 X
5,695,067 * 12/1997 Harvey ..... 206/579
6,025,040 * 2/2000 Brockley ..... 40/800 X

* cited by examiner

*Primary Examiner*—Peter M. Cuomo
*Assistant Examiner*—Hanh V. Tran
(74) *Attorney, Agent, or Firm*—Shook, Hardy & Bacon LLP

(57) ABSTRACT

A device for displaying items having a top layer of material and an item supporting material joined together and having at least one aperture therein for receiving a portion of the item to be displayed is provided. A bottom layer of material is joined with the item supporting material. A frame receives the joined top layer of material, item supporting material and bottom layer of material. A method of constructing the device includes joining the top layer of material and the item supporting material, forming at least one aperture therein, joining the bottom layer of material to the item supporting material and receiving the joined top layer of material, item supporting material and bottom layer of material in the frame.

9 Claims, 2 Drawing Sheets

Fig. 3.
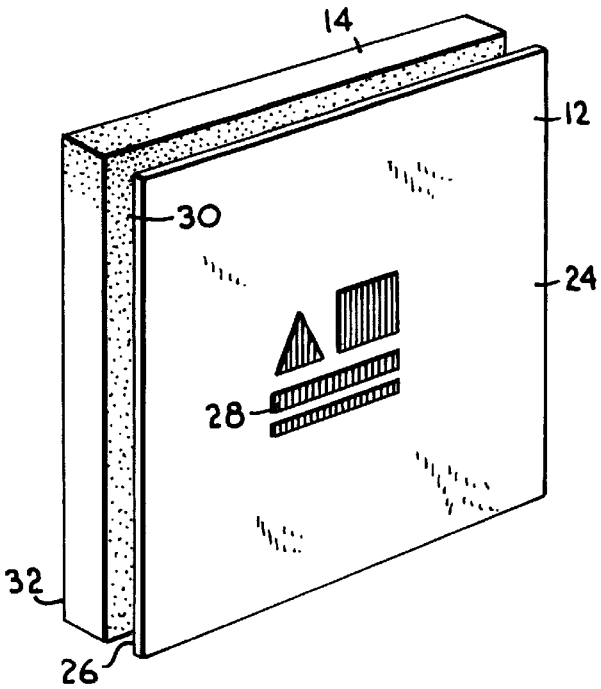
Fig. 4.
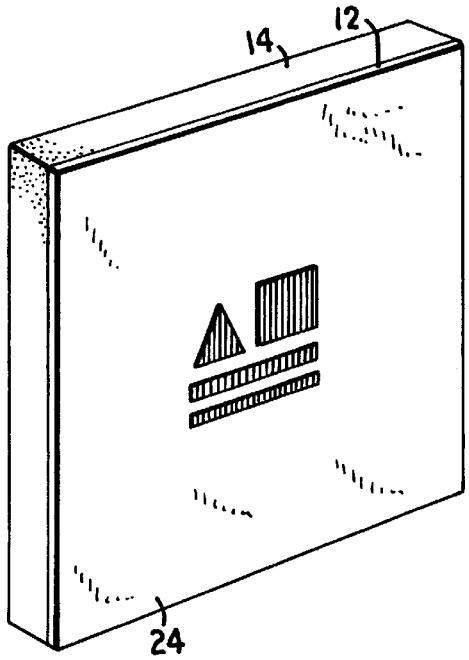
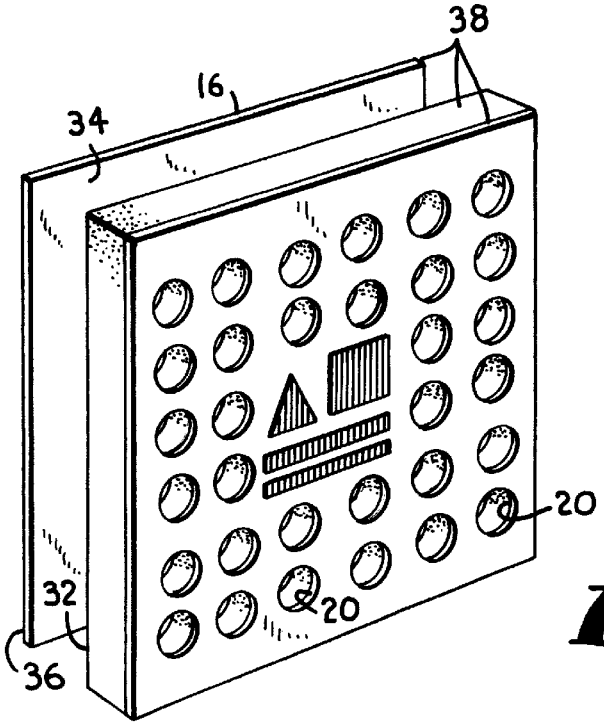
Fig. 5.

DEVICE FOR DISPLAYING ITEMS AND METHOD OF MAKING SAME

CROSS-REFERENCE TO RELATED APPLICATIONS

The present application is a continuation of application Ser. No. 29/105,157, filed May 19, 1999, now U.S. Pat. No. D441,223.

STATEMENT REGARDING FEDERALLY SPONSORED RESEARCH OR DEVELOPMENT

Not Applicable.

BACKGROUND OF THE INVENTION

This invention relates to a device for displaying items and a method of making the same. More specifically, this invention relates to a multi-layered structure that contains apertures therein for receiving a portion of the items to be displayed. The structure may be received in a frame to further enhance the appearance of the items being displayed.

In today's society people often collect various items that are important to them for one reason or another. A perfect example of such a situation is found in the large number of people who collect golf balls with logos on them. The golf balls can represent golf courses the person has played or company logos that the person finds interesting. Perhaps the ball even has some special meaning as it was the ball used to win a tournament or, if the person is lucky enough, was the ball that they shot a hole in one with. For whatever reason individuals collect items such as golf balls or baseballs or matchbox cars, these people often desire to display these items in an organized and attractive fashion.

With reference to golf balls, numerous display cases exist in the prior art for displaying a collection of golf balls in an organized fashion. The most common display includes several rows of shelves with spaced apart notches thereon to allow the golf balls to rest on the shelves in a uniformly spaced manner. A drawback of this particular method of displaying items, be it golf balls, baseballs or other items, is that the shelf that the items rests upon often obstructs the view of items being displayed on the upper shelves. Other drawbacks associated with this method of displaying items include the items not being securely positioned in the display such that a slight movement of the display could cause all of the items to move from their aligned position or, worse yet, fall out of the display and damage themselves or injure someone. Additionally, since the majority of these types of displays are often fabricated out of wood, the displays do not readily lend themselves to providing a means for customizing the display to the particular individual or the particular items being displayed.

The need remains in the display industry for a device that overcomes the drawbacks of the prior art and solves the aforementioned and other problems. The primary objective of this invention is to meet this need.

BRIEF SUMMARY OF THE INVENTION

More specifically, an object of the invention is to provide a device for displaying items which does not obstruct the view of an important portion of the item being displayed.

Another object of the invention is to provide a device for displaying items which securely holds the item being displayed in place yet readily and easily permits insertion and removal of the item to be displayed without damaging the item.

Yet another object of the invention is to provide a device for displaying items which can be readily customized and tailored to the item or items being displayed by the addition of a graphic, a design, a logo and/or a writing.

In summary, a device for displaying items having a top layer of material and an item supporting material joined together and having at least one aperture therein for receiving a portion of the item to be displayed is provided. A bottom layer of material is joined with the item supporting material. A frame receives the joined top layer of material, item supporting material and bottom layer of material. A method of constructing the device includes joining the top layer of material and the item supporting material, forming at least one aperture therein, joining the bottom layer of material to the item supporting material and receiving the joined top layer of material, item supporting material and bottom layer of material in the frame.

Other and further objects of the invention, together with the features of novelty appurtenant thereto, will appear in the description of the drawings.

BRIEF DESCRIPTION OF THE SEVERAL VIEWS OF THE DRAWING

In the following description of the drawings, in which like reference numerals are employed to indicate like parts in the various views:

FIG. 3 is a perspective view of the top layer of material and the item supporting material of the device prior to being joined together and having apertures formed therein;

FIG. 4 is a perspective view of the top layer of material and the item supporting material of the device joined together prior to having apertures formed therein;

FIG. 5 is a perspective view of the top layer of material and the item supporting material of the device joined together and having apertures formed therein and the bottom layer of material prior to being joined to the item supporting material.

DETAILED DESCRIPTION OF THE INVENTION

Figure 1:
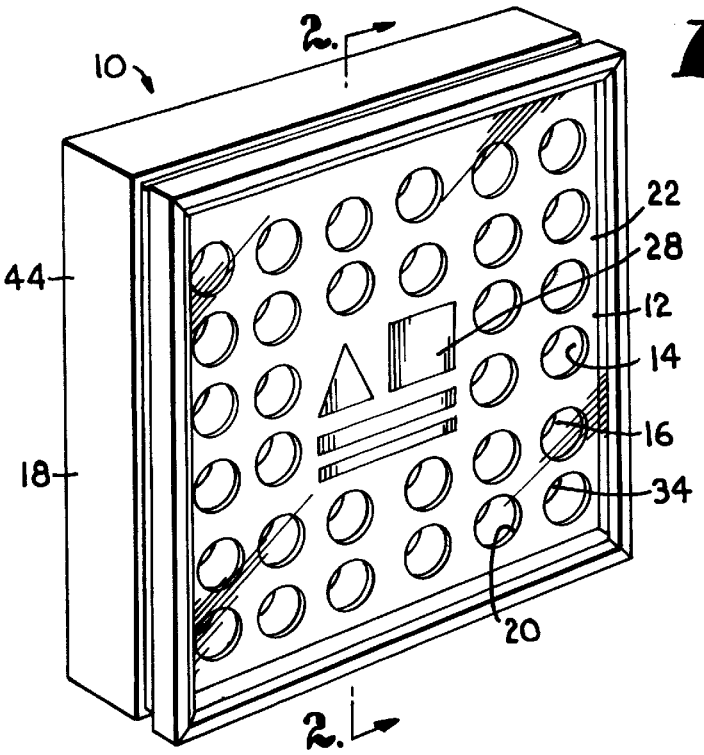
FIG. 1 is a perspective view of a device for displaying items constructed in accordance with a first embodiment of the invention.
Figure 2:
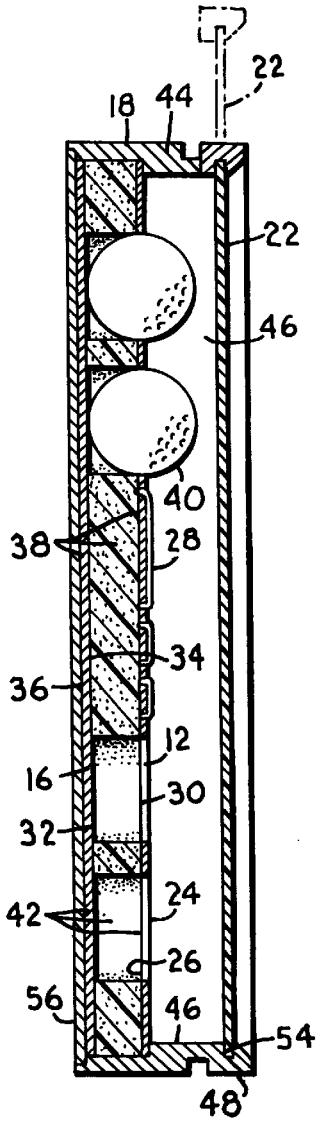
FIG. 2 is a cross-sectional view of the device of FIG. 1 taken generally along line 2—2.
Figure 6:
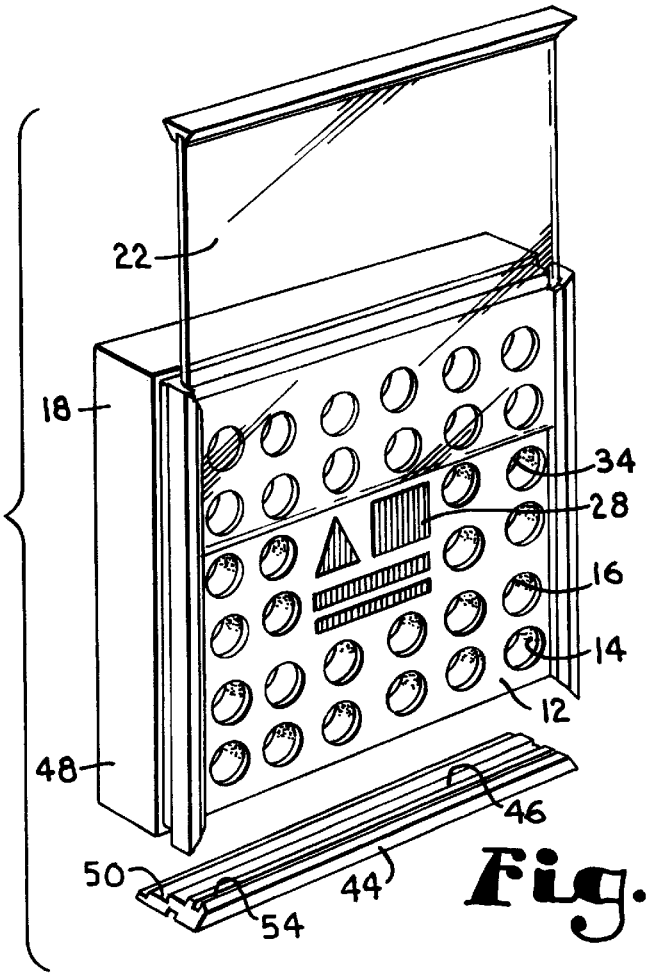
FIG. 6 is a perspective view of the device illustrating the insert being received in the frame, the cover being slidably received in the frame and the bottom wall of the frame in an exploded state to illustrate the interior surface of the frame.

Referring to the drawings in greater detail, attention is first directed to FIG. 1, wherein numeral 10 generally designates a first embodiment of a device for displaying items. The device 10 generally includes a top layer of material 12, an item supporting material 14, a bottom layer of material 16 and a frame 18. The device preferably also includes at least one aperture 20 and a cover 22.

The top layer of material 12 has a top surface 24 and a bottom surface 26. The top layer of material is preferably cloth or fabric. More preferably, the top layer of material is felt. By having the top layer of material 12 be cloth, the top layer is readily adaptable to permit customization of the device 10.

For example, in a preferred embodiment, the top layer of material has a design 28 placed on the top surface 24 of the top layer of material 12. The design 28 may take the form of a graphic, a logo, and/or a writing which relates in some manner to the items being displayed. In a preferred embodiment, the design is embroidered on the top layer of material 12. However, the design may, of course, be silk screened on the top surface 24 or may be applied thereto in any manner known in the art.

The item supporting material 14 has a top surface 30 and a bottom surface 32. When the device 10 is fully assembled, the item supporting material 14 and the top layer of material 12 are joined together in a manner where the bottom surface 26 of the top layer 12 faces the top surface 30 of the item supporting material 14. The top layer 12 and the item supporting material 14 may be joined together in numerous ways including stitching or some other type of fastening arrangement. However, in a preferred embodiment, the top layer of material 12 and the item supporting material 14 are adhered to each other, preferably via a glue.

The item supporting material 14 may be constructed of any material which would permit sufficient support of the items to be displayed. However, it has been found beneficial to have the item supporting material 14 be constructed of foam as foam has been found to permit the item supporting material 14 to frictionally and securely receive and support the item to be displayed. Additionally, it has been found beneficial to have the thickness of the item supporting material be determined by the thickness of the item being displayed. For example, if the device will be used for displaying standard size golf balls with a diameter of 1.68 inches, a one inch thick item supporting material has been found beneficial. In this arrangement, the thickness of the item supporting material is about 60% the thickness of the golf ball. This relationship permits the item supporting material to securely hold the golf ball in place while still allowing a large part of the ball to protrude from the top layer of material for unobstructed viewing.

Additionally, it has been found that when the item being displayed is spherical, such as a golf ball or a baseball, the thickness of the item supporting material should be between ½ to ¾ the diameter of the item being displayed. Because the item being displayed is round, its circumference is widest at ½ its height. Consequently, if the thickness of the item supporting material is less than ½ the diameter of the item being displayed, the majority of the item is located outside the aperture and the item is more likely to fall out of the aperture. On the other hand, if the thickness of the item supporting material is greater than ¾ the diameter of the item being displayed, very little of the item being displayed is viewable from any location other than directly straight on. In other words, the thickness of the item supporting material should be a little bit more than half the diameter of the item being displayed. This arrangement has been found to strike a good balance between support and viewablity.

The bottom layer of material 16 has a top surface 34 and a bottom surface 36. When the device 10 is fully assembled, the bottom layer 16 and the item supporting material 14 are preferably joined in such a way that the top surface 34 of the bottom layer 16 and the bottom surface 32 of the item supporting material 14 face each other. As with the joining of the top layer 12 and the item supporting material 14, the bottom layer 16 and the item supporting material 14 are preferably joined via a glue. As before, it should be noted that the bottom layer 16 and the item supporting material 14 may be joined to each other by other methods including stitching, fastening or even a simple frictional fit or abutment as described below.

The bottom layer 16 is preferably cloth. More preferably, the bottom layer is constructed of the same material as the top layer 12.

It should be noted at this time that when the top layer of material 12, the item supporting material 14 and the bottom layer of material 16 are all joined together, a unitary multilayer structure or laminate 38 is formed. While the structure 38 is capable of supporting and displaying the items to be displayed, for example a golf ball 40, the device 10 preferably also includes the frame 18. When the frame 18 is included, the structure 38 defines an insert 42 which is received in the frame 18.

The frame 18 preferably includes a plurality of walls or sides 44 which have an interior surface 46 and an exterior surface 48. The walls 44 include a first groove 50 in the interior surface 46 which is sized to receive the insert 42. To prevent dust from accumulating on the top surface 24 of the top layer of material 12 and on the items being displayed, the frame 14 preferably includes the cover 22. The cover 22 may be constructed of any type of transparent material that would permit viewing of the items being displayed while still covering the items and protecting them from exposure to dust. Preferably, the cover is constructed of glass or plexiglass. To permit ready access to the insert 42 so that items may be added or removed to the display, the cover 22 is preferably slidably connected with the frame 18 by being received in a second groove 54 in the interior surface 46 of the frame 18.

The aperture or apertures 20, depending on the number of items to be displayed, is/are preferably formed only in the top layer of material 12 and the item supporting material 14. In this arrangement, the bottom layer of material 16 provides a backing or a closure to the aperture to prevent the item being displayed from falling through the aperture and out a backside 56 of the structure 38 or insert 42. Additionally, by not providing the apertures 20 in the bottom layer of material 16, the top surface 34 of the bottom layer of material 16 may be seen in the aperture 20 when the aperture is not receiving an item to be displayed. This has been found to be more visually pleasing than seeing a wall upon which the structure is hung or a back panel 56 of the frame 18.

The aperture or apertures 20 are preferably sized according to the shape of the item or items being displayed. Preferably the aperture has a shape which corresponds to the item being displayed and the size of the aperture is slightly smaller than the outline of the item being displayed to permit a frictional fit and intimate contact between the item and aperture. For example, if the items being displayed are golf balls, the apertures are preferably cylindrical bores of a diameter slightly less than the diameter of a golf ball. A 1.625 inch diameter bore in one inch thick foam has been found to be beneficial when the display is used to display standard size golf balls with a diameter of 1.680 inches. This arrangement permits the aperture to securely and frictionally receive a golf ball not only at its midpoint, but also a portion of the ball on either side thereof.

A preferred method of constructing the device 10 includes first obtaining the top layer material 12, the item supporting material 14 and the bottom layer of material 16. If the top layer material 12 is to include a design 28 which is embroidered thereon, it has been found preferable to embroider the design on the top layer of material prior to it being joined with the item supporting material. Preferably, after joining the top layer of material and the item supporting together, the apertures 20 are formed in the top layer and item supporting material combination. While corresponding apertures could be individually formed in the top layer of material and the item supporting material prior to their being joined together since when they are joined together the aperture 20 is provided in the combination of the top layer of material and the item supporting material, it has been found easier to form the aperture in the top layer and item supporting material combination than to attempt to align apertures formed separately in the top layer of material and the item supporting material.

The bottom layer of material 16 is then preferably joined with the item supporting material and the structure 38 or insert 42 is present. The insert 42 is then received in the first groove 50 of the frame 18. Alternatively, the bottom layer of material may be applied orjoined to the back panel 56 of the frame 18. The combination top layer of material and item supporting material is then received in the first groove 50 of the frame. In this arrangement, the bottom layer and the item supporting material are notjoined during use, but merely abut each other. In use, however, the two arrangements create the same visual impression.

In operation, the cover 22 maybe slid upwardly, thereby giving the user of the device access to the apertures 20 in the insert 42. The user may then insert the items to be displayed in the aperture desired. Similarly, the user may remove items being displayed by simply removing the item from its corresponding aperture.

Constructed and operated as previously described, this invention provides a device for displaying items in an organized and secure fashion. A portion of each item to be displayed is frictionally received in the aperture and the item is thereby securely positioned in the display such that movement of the display does not cause the item to be jostled or to fall out. Additionally, this invention provides a device for displaying items which can be readily customized via embroidery to fit the needs of the user. Further still, this invention provides a device for displaying items that does not obstruct the view of the items being displayed.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

What is claimed is:

1. A device for displaying items, the device comprising:

a top layer of material having a top surface and a bottom surface and at least one aperture formed therethrough;

an item supporting material having a top surface and a bottom surface, wherein the item supporting material and the top layer of material are joined together such that the bottom surface of the top layer and the top surface of the item supporting material face each other, wherein the item supporting material has at least one aperture formed therein, and wherein the aperture in the top layer and the aperture in the item supporting material cooperate to define a recess for receiving a portion of the item to be displayed; and a bottom layer of material having a top surface and a bottom surface, the bottom layer of material and the item supporting material being joined together such that the bottom surface of the item supporting material and the top surface of the bottom layer of material face each other, and wherein a portion of the bottom layer of material covers the aperture in the item supporting material adjacent the bottom surface of the item supporting material whereby the top surface of the bottom layer of material is visible when the device is viewed from the top layer.

2. The device of claim 1, wherein the top layer is cloth and it has a design embroidered thereon.

3. The device of claim 2, wherein the wherein the top layer is felt.

4. The device of claim 1, wherein the item supporting material is foam.

5. The device of claim 1, wherein the top layer of material and the item supporting material have a plurality of apertures therein which cooperate to define a plurality of recesses for receiving portions of a plurality of items to be displayed.

6. The device of claim 5, wherein the top layer of material, the item supporting material and the bottom layer of material collectively define an insert, the device further comprising:

a frame having a groove in an interior surface, and wherein the insert is received in the groove.

7. The device of claim 6, wherein the frame further includes a second groove in the interior surface, the device further comprising:

a cover, the cover being slidably received in the second groove.

8. The device of claim 1, wherein the top layer of material, the item supporting material and the bottom layer of material collectively define an insert, the device further comprising:

a frame having a groove in an interior surface, and wherein the insert is received in the groove.

9. The device of claim 8, wherein the frame further includes a second groove in the interior surface, the device further comprising:

a cover, the cover being slidably received in the second groove.

* * * * *